United States Patent [19]

Röck

[11] Patent Number: 4,983,000

[45] Date of Patent: Jan. 8, 1991

[54] PIECE OF FURNITURE WITH AT LEAST ONE DRAWER

[75] Inventor: Erich Röck, Höchst, Austria

[73] Assignee: Julius Blum Gesellschaft m.b.H., Höchst, Austria

[21] Appl. No.: 418,633

[22] Filed: Oct. 10, 1989

[30] Foreign Application Priority Data

Oct. 11, 1988 [AT] Austria ..... 2504/88
Oct. 11, 1988 [AT] Austria ..... 2505/88

[51] Int. Cl.[5] ..... A47B 88/00
[52] U.S. Cl. ..... 312/333; 312/341.1
[58] Field of Search ..... 312/307, 341.1, 333, 312/323

[56] References Cited

U.S. PATENT DOCUMENTS

| | | | |
|---|---|---|---|
| 1,816,213 | 7/1931 | Duke | 312/323 X |
| 2,005,938 | 6/1935 | Graves | 312/323 X |
| 3,666,342 | 5/1972 | Biesecker | 312/333 |
| 4,065,196 | 12/1977 | Stein | 312/341.1 |
| 4,763,809 | 8/1988 | Miller et al. | 312/333 X |

*Primary Examiner*—Joseph Falk
*Attorney, Agent, or Firm*—Wenderoth, Lind & Ponack

[57] ABSTRACT

An article of furniture includes at least one drawer which is held between two side walls of the body of the article of furniture by a pull-out guide assembly including, on each side of the drawer, a supporting rail at the side of the body and a pull-out rail at the side of the drawer. The supporting rails are mounted at front and at rear bearing points at the body side walls. At the rear bearing points, the supporting rails are height-adjustably mounted and guided so that the pivoting movement of the supporting rails is limited.

21 Claims, 5 Drawing Sheets

PIECE OF FURNITURE WITH AT LEAST ONE DRAWER

FIELD OF THE INVENTION

The invention relates to an article of furniture with at least one drawer which is held between two body side walls or the like by means of a pull-out guide assembly, the pull-out guide assembly including, on each side of the drawer, a supporting rail at the side of the body and a pull-out rail at the side of the drawer.

SUMMARY OF THE INVENTION

It is the object of the invention to provide an article of furniture of the afore-mentioned type in which the drawer is, when being pushed into the body of the article of furniture as well as when being extracted therefrom, automatically brought into its respective end position. It should particularly be prevented that the drawer, when it has been pushed into the body of the article of furniture without care, projects therefrom.

According to the invention this is achieved in that the supporting rails are at their front ends mounted to the body side walls to be pivotable about horizontal axles which are formed by screws or the like, and that guide means defining the pivoting path of the supporting rails are provided at the rear ends of the supporting rails.

By this arrangement according to the invention, the rear end of the inserted drawer tilts downwardly towards the rear and is pulled by its own weight into the body of the article of furniture. The drawer when extracted tilts towards its front and thus seeks its front end position.

Guiding of the supporting rails is limited in a simple manner by providing the rear ends of the supporting rails with substantially vertical slots through which project screws or the like which form stops limiting the pivoting movement of the supporting rails.

One embodiment of the invention provides that each supporting rail is at a rear bearing point thereof height-adjustably mounted at the body side wall by means of an eccentric, such eccentric having stop surfaces for a stop member associated with the drawer. The controlled guiding provided by the eccentric ensures that the supporting rails are tilted uniformly. The load distribution within the drawer has no influence on the tilting movement thereof.

It is advantageously provided that the supporting rails have at their front and rear ends upwardly projecting flaps through which extend the screws.

A further feature of the invention provides that the pull-out rails are mounted at the drawer obliquely to the drawer bottom with the distance of the pull-out rails to the drawer bottom being greater at the front of the drawer than at the rear thereof. Thus, the drawer when pushed into the body of the article of furniture is in a horizontal position, even when the pull-out rails are directed obliquely from the front to the rear.

BRIEF DESCRIPTION OF THE DRAWINGS

In the following embodiments of the invention will be described in more detail with reference to the accompanying drawings, in which.

DESCRIPTION OF THE PREFERRED EMBODIMENTS

Figures 1, 2:
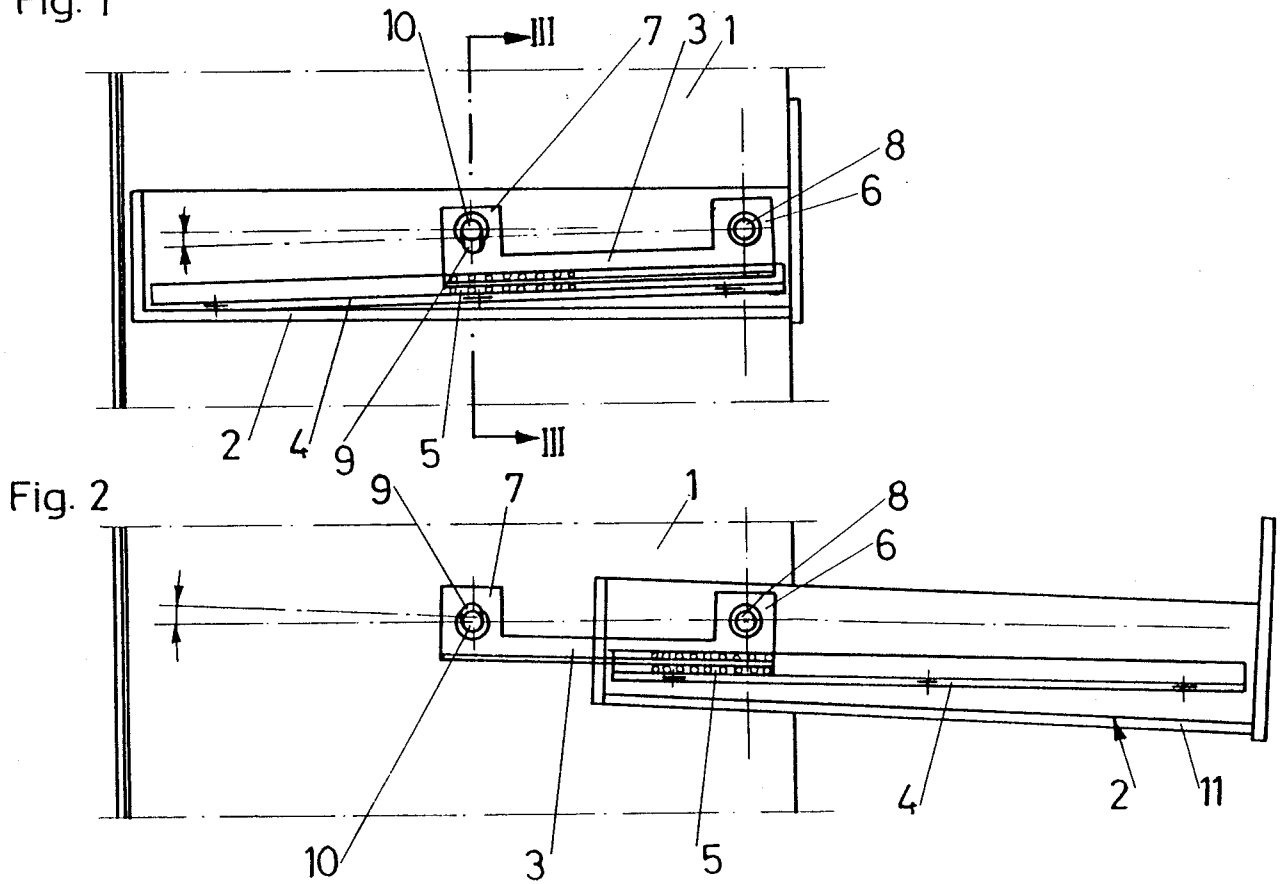
FIG. 1 is a diagrammatic side view of an article of furniture according to one embodiment of the invention and including a drawer shown in a pushed-in position.
FIG. 2 is a similar side view with the drawer being shown extracted from the body of the article of furniture.

In the drawings, a body side wall is indicated by reference number 1 and a drawer by reference number 2. A supporting rail 3 is fastened to the body side wall 1, whereas a pull-out rail 4 is fastened to a side wall of the drawer.

Figure 3:
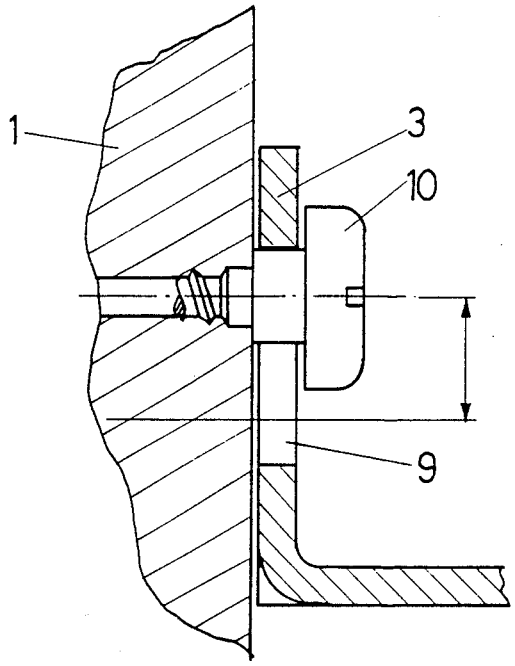
FIG. 3 is a sectional view along line III—III of FIG. 1.
Figure 4:
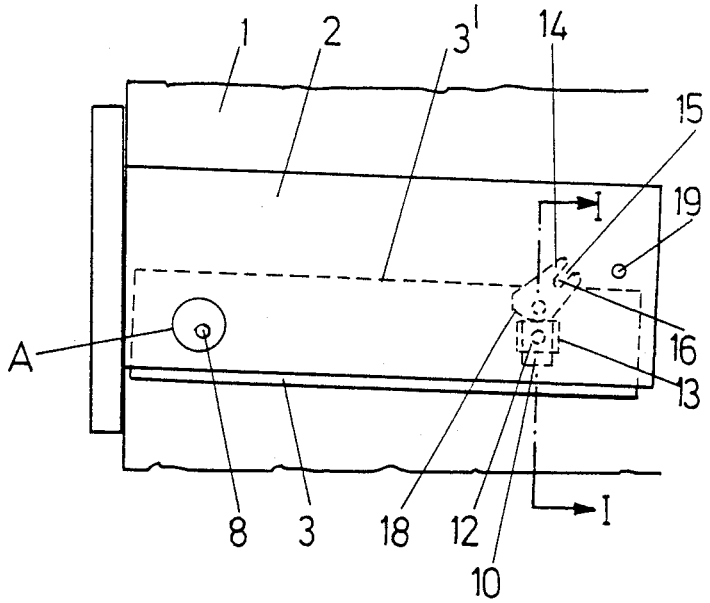
FIG. 4 is a side view of the drawer in the pushed-in position with a pull-out guide assembly according to another embodiment of the invention.
Figure 5:
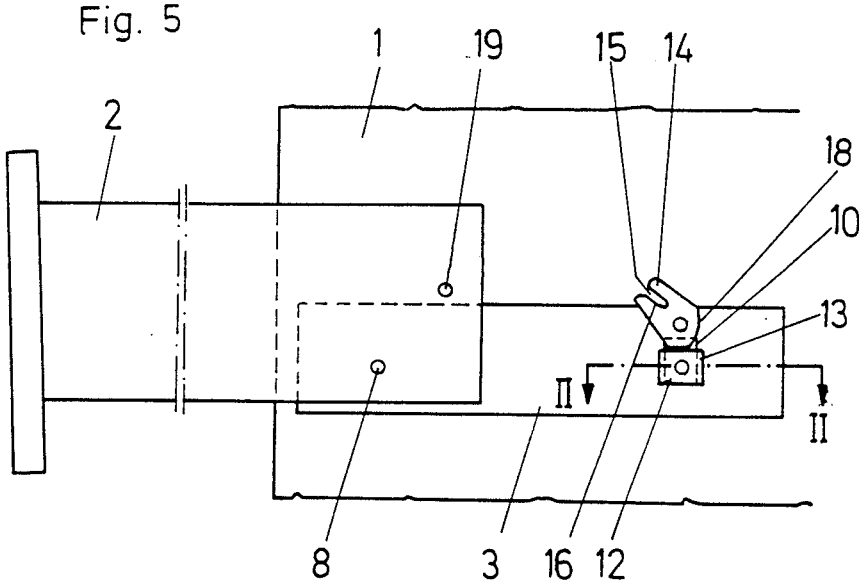
FIG. 5 is a similar side view of the pull-out guide assembly, the drawer being shown extracted from the body of the article of furniture.
Figure 6:
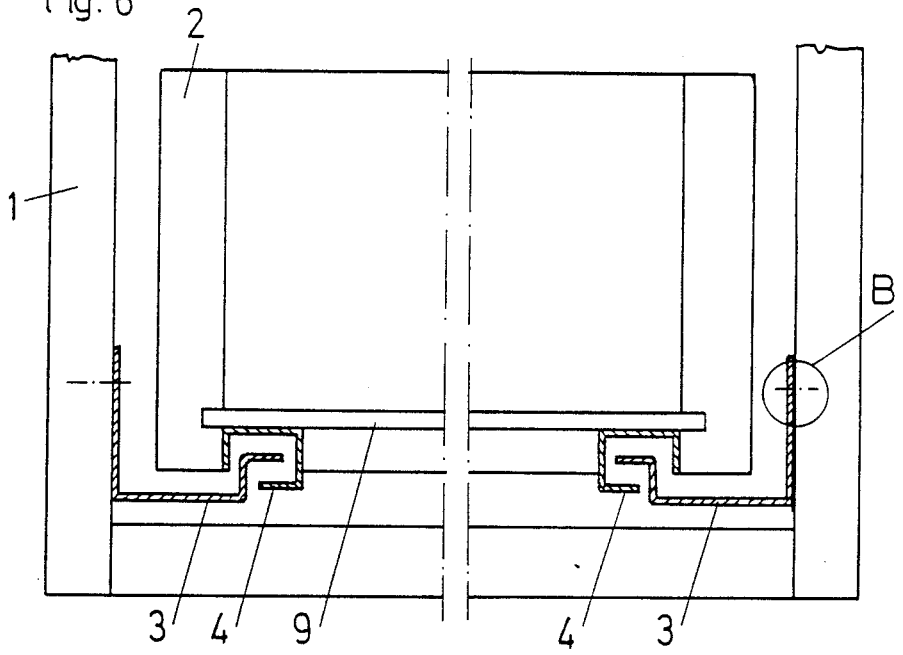
FIG. 6 is a diagrammatic cross-sectional view thereof.
Figure 7:
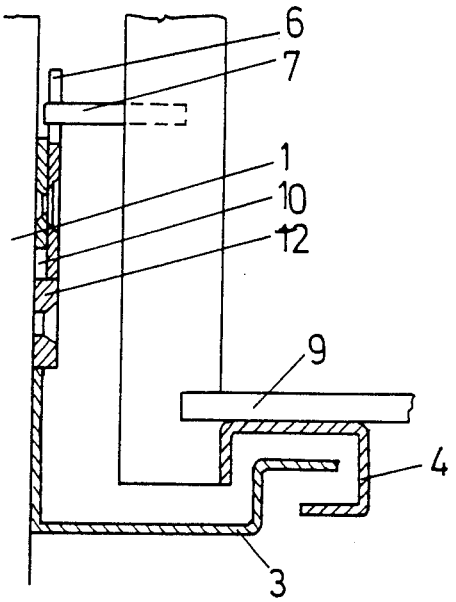
FIG. 7 is a sectional view along line VII—VII of FIG. 4.
Figure 8:
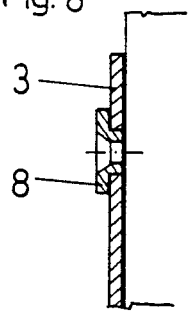
FIG. 8 is an enlarged sectional view along line VIII—VIII of FIG. 5.

A guide assembly of the embodiment according to FIGS. 1 to 3 comprises a running carriage 5 in which balls are mounted. By means of the balls of the running carriage 5 the weight of the drawer 2 is transmitted from the pull-out rails 4 to the supporting rails 3.

The pull-out guide assembly could also be provided with slides or rollers or ball bearings mounted on the pull-out rails 4 and the supporting rails 3. The type of arrangement for transmitting the load from the pull-out rails 4 to the supporting rails 3 does not influence the principle of the manner of tilting of the supporting rails 3. In the latter-mentioned cases, the supporting rail 3 would have to be extended, i.e. it would have to be substantially as long as the pull-out rail 4 in conventional pull-out assemblies.

The supporting rail 3 is at its front end and at its rear end provided with upwardly projecting flaps or portions 6, 7. A fastening screw or bolt which forms a pivot bearing 8 for the supporting rail 3 projects through a hole in the front flap 6. The rear flap 7 is provided with a substantially vertical slot 9 through which projects a screw or bolt 10 screwed into the furniture side wall 1. The screw 10 and the slot 9 together form a guide means for the supporting rail 3. The length of the slot 9 defines the path of tilting of the supporting rail 3. It will be appreciated that the screw 10 clamps the supporting rail 3 to the body side wall 1. The slot 9 may be slightly curved.

As can particularly be seen from FIG. 2, the pull-out rail 4 is obliquely mounted at the drawer 2, which means that the distance of the pull-out rail 4 from the drawer bottom 11 is slightly greater at the front of the drawer than at the rear. Due to this arrangement, when the drawer is in its pushed-in position it is horizontal, even when the rails 3, 4 are tilted downwardly at the rear, as can be seen from FIG. 1.

In the illustrated embodiment, the supporting rail 3 has substantially half the length of the pull-out rail 4.

In the embodiment according to FIGS. 4 to 10, the front end of each supporting rail is pivotally fastened to the body side wall 1 by means of a pivot bearing 8. Close to its rear end, each supporting rail has formed in a vertical flange 3' thereof a vertical slot 9. In the region of the slot 9, a block member 12 is fastened to the body side wall 1. The body member 12 projects through the slot 9 and advantageously has lateral flanges 13 which extend in opposite longitudinal directions beyond the edges of slot 9. The supporting rails 3 are thus guided between the lateral flanges 13 of the block members 12 and the body side walls 1.

Directly above the block member 12, an eccentric 14 is pivotally mounted at the supporting rail 3 on each side of the drawer 2. The eccentric 14 has a curved supporting cam surface or face 18. Obviously, the eccentric 14 could also be a simple two-arm lever which, however, would not allow a controlled tilting of the supporting rail 3 over the complete course of movement. As can be seen from the drawings, the eccentrics 14 abut directly on the block members 12 so that the supporting rails 3 are supported at the rear thereof by means of the eccentrics 14 and the block members 12 at the body side walls 1.

Figure 9:
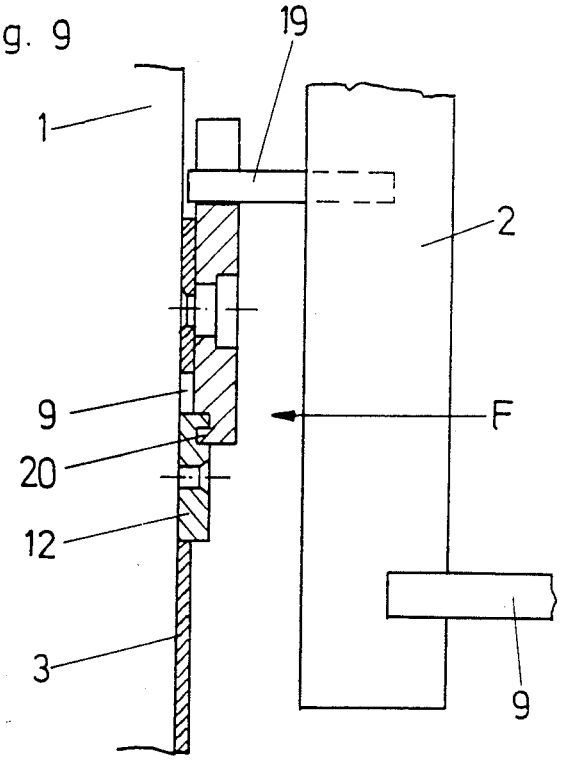
FIG. 9 is a sectional view similar to FIG. 7 but showing a further feature of the invention.
Figure 10:
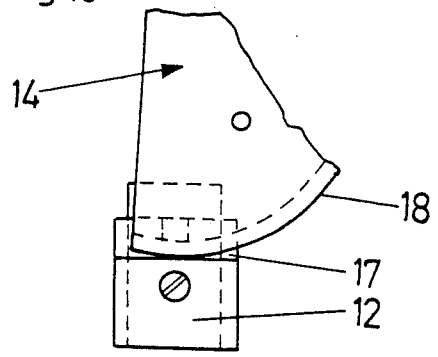
FIG. 10 is a view from the direction of arrow F in FIG. 9.

To improve the control of the tilting movement, the arrangement shown in FIGS. 9 and 10 provides that the eccentric 14 and the block member 12 are arranged in toothed engagement, such that, even in the case of a shock-like movement of the drawer 2, the eccentric 14 with the supporting rail 3 are definitely not lifted from the block member 12. In this embodiment, the eccentric 14 has a curved marginal flange 20 which extends into a corresponding groove 17 of the block member 12. It will be appreciated that one wall of the groove 17 has to be adapted to the curvature of the marginal flange 20.

The top of each eccentric 14 is provided with a slit 15 which is open on one side. Pins 19 are fastened to the drawer side walls.

When the pins 19 are moved toward the eccentrics 14, since they are located at the height of the slits 15, they pass into the slits and abut on rear or front limiting surfaces 16 of the slits 15, depending on the direction of movement. In this arrangement, the limiting surfaces 16 form stop surfaces. The pins 19 are displaced by the movement of the drawer and, when the pins are in the slits 15, the eccentrics 14 are pivoted. By pivoting the eccentrics 14, the supporting rails 3 are lifted or lowered, such movement being guided by engagement of block members 12 in slots 9. Tilting of the supporting rails 3 downwardly towards the rear guarantees that the drawer 2 moves fully into the body of the article of furniture, even when the drawer has been closed without care.

The transmission of load between the pull-out rails 4 and the supporting rails 3 can be effected by conventional means, for example by rigidly mounted runner rollers, slides or running carriages.

What is claimed is:

1. In an article of furniture including at least one drawer mounted between two body side walls by a pull-out guide assembly and guided thereby for movement between inserted and withdrawn positions, said pull-out guide assembly comprising, on each of opposite sides of said drawer, a supporting rail mounted on a respective body side wall, and a pull-out rail longitudinally slidably guided relative to said supporting rail and mounted on a respective side of said drawer, the improvement wherein said pull-out guide assembly further comprises, on each of said opposite sides of said drawer:

means mounting said supporting rail adjacent a front end portion thereof to the respective said body side wall for pivotal movement about a horizontal axis relative to said respective body side wall; and guide means, located at a rear end portion of said supporting rail, for guiding said pivotal movement of said supporting rail and for limiting the extend of said pivotal movement in opposite directions about said axis.

2. The improvement claimed in claim 1, wherein said mounting means comprises a member extending through said front end portion of said supporting rail and fixed to said respective body side wall, said member defining said axis.

3. The improvement claimed in claim 1, wherein said supporting rail includes upwardly extending portions at said front and rear end portions, said mounting means being at the front said upwardly extending portion, and said guide means being at the rear said upwardly extending portion.

4. The improvement claimed in claim 1, wherein said guide means comprises a substantially vertical slot formed in said rear end portion of said supporting rail, and a member extending through said slot and fixed to said respective body side wall.

5. The improvement claimed in claim 4, wherein said member comprises a screw, such that abutment of said screw at opposite ends of said slot limits the extent of said pivotal movement of said supporting rail in opposite directions about said axis.

6. The improvement claimed in claim 4, wherein said member comprises a block-like member.

7. The improvement claimed in claim 6, wherein said block-like member has laterally extending flanges, such that said supporting rail is guided between said respective body side wall and said laterally extending flanges.

8. The improvement claimed in claim 4, further comprising means for, upon said drawer being moved to said inserted and said withdrawn positions, causing said supporting rail to pivot about said axis in a respective said opposite direction, said causing means comprising an eccentric member rotatably mounted on said supporting rail and having an eccentric cam surface abutting said member, and a projecting element extending from said respective side of said drawer at a position such that, upon movement of said drawer to one of said inserted or withdrawn positions, said projecting element causes rotation of said eccentric member resulting in, due to contact of said eccentric cam surface with said member, pivotal movement of said supporting rail about said axis in a respective of said opposite directions.

9. The improvement claimed in claim 8, wherein said eccentric member and said member are arranged in toothed engagement.

10. The improvement claimed in claim 8, wherein said eccentric member has limiting surfaces to limit the extent of rotation of said eccentric member by said projecting element.

11. The improvement claimed in claim 10, wherein said limiting surfaces are defined by an open-ended slit formed in said eccentric member at a position such that said projecting element enters said slit upon movement of said drawer to said inserted and withdrawn positions.

12. The improvement claimed in claim 1, wherein said pull-out rail is mounted on said respective side of said drawer obliquely to the longitudinal direction of said drawer, such that the distance between said pull-out rail and the bottom of the drawer is greater at the front of the drawer than at the rear thereof.

13. In a pull-out guide arrangement for use on either of opposite sides of a drawer to guide movement thereof between inserted and withdrawn positions relative to a respective body side wall of an article of furniture, said pull-out guide arrangement comprising a supporting rail to be mounted on the respective body side wall, and a pull-out rail longitudinally slidably guided relative to said supporting rail and to be mounted on a respective side of the drawer, the improvement comprising:

means for mounting said supporting rail adjacent a front end portion thereof to the respective body side wall for pivotal movement about a horizontal axis relative thereto, said mounting means comprising a member extending through said front end portion of said supporting rail and to be fixed to the respective body side wall, said member defining said axis; and guide means, located at a rear end portion of said supporting rail, for guiding said pivotal movement of said supporting rail and for limiting the extent of said pivotal movement in opposite directions about said axis, said guide means comprising a substantially vertical slot formed in said rear end portion of said supporting rail, and a member extending through said slot and to be fixed to the respective body side wall.

14. The improvement claimed in claim 13, wherein said supporting rail includes upwardly extending portions at said front and rear end portions, said mounting means being at the front said upwardly extending portion, and said guide means being at the rear said upwardly extending portion.

15. The improvement claimed in claim 13, wherein said member comprises a screw, such that abutment of said screw at opposite ends of said slot limits the extend of said pivotal movement of said supporting rail in opposite directions about said axis.

16. The improvement claimed in claim 13, wherein said member comprises a block-like member.

17. The improvement claimed in claim 16, wherein said block-like member has laterally extending flanges.

18. The improvement claimed in claim 13, further comprising means for, upon said pull-out rail being moved to inserted and the withdrawn positions relative to said supporting rail, causing said supporting rail to pivot about said axis in a respective said opposite direction, said causing means comprising an eccentric member rotatably mounted on said supporting rail and having an eccentric cam surface abutting said member, and a projecting element to extend from the respective side of the drawer at a position such that, upon movement of the pull-out rail to one of the inserted or withdrawn positions, said projecting element causes rotation of said eccentric member resulting in, due to contact of said eccentric cam surface with said member, pivotal movement of said supporting rail about said axis in a respective of said opposite directions.

19. The improvement claimed in claim 18, wherein said eccentric member and said member are arranged in toothed engagement.

20. The improvement claimed in claim 18, wherein said eccentric member has limiting surfaces to limit the extend of rotation of said eccentric member by said projecting element.

21. The improvement claimed in claim 20, wherein said limiting surfaces are defined by an open-ended slit formed in said eccentric member at a position such that said projecting element enters said slit upon movement of the drawer to the inserted and withdrawn positions.

* * * * *